US009897108B2

(12) United States Patent
Tadokoro et al.

(10) Patent No.: US 9,897,108 B2
(45) Date of Patent: Feb. 20, 2018

(54) PROPELLER FAN, AIR BLOWER, OUTDOOR UNIT

(71) Applicant: Mitsubishi Electric Corporation, Tokyo (JP)

(72) Inventors: Takahide Tadokoro, Tokyo (JP); Yasuaki Kato, Tokyo (JP); Atsushi Kono, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 287 days.

(21) Appl. No.: 14/654,673

(22) PCT Filed: Dec. 10, 2013

(86) PCT No.: PCT/JP2013/083076
§ 371 (c)(1),
(2) Date: Jun. 22, 2015

(87) PCT Pub. No.: WO2014/103702
PCT Pub. Date: Jul. 3, 2014

(65) Prior Publication Data

US 2015/0345513 A1 Dec. 3, 2015

(30) Foreign Application Priority Data

Dec. 27, 2012 (JP) ..... PCT/JP2012/083898

(51) Int. Cl.
*F04D 29/66* (2006.01)
*F04D 17/08* (2006.01)
(Continued)

(52) U.S. Cl.
CPC ..... *F04D 29/663* (2013.01); *F04D 17/08* (2013.01); *F04D 25/02* (2013.01); *F04D 29/281* (2013.01);
(Continued)

(58) Field of Classification Search
CPC .... F04D 29/325; F04D 29/281; F04D 29/601; F04D 29/626; F04D 19/002
(Continued)

(56) References Cited

U.S. PATENT DOCUMENTS 4,150,919 A * 4/1979 Matucheski ..... F04D 29/329 416/169 A
2008/0253897 A1* 10/2008 Yamamoto ..... F04D 29/384 416/223 R
2010/0266428 A1* 10/2010 Nakagawa ..... F04D 29/164 417/321

FOREIGN PATENT DOCUMENTS

EP 2042820 A2 * 4/2009 ..... F24F 1/10
JP H09-068199 A 3/1997
(Continued)

OTHER PUBLICATIONS

International Search Report of the International Searching Authority dated Mar. 11, 2014 for the corresponding international application No. PCT/JP2013/083076 (and English translation).

*Primary Examiner* — Kenneth Bomberg
*Assistant Examiner* — Hoon Choi
(74) *Attorney, Agent, or Firm* — Posz Law Group, PLC

(57) ABSTRACT

An inner peripheral side of the blade with respect to an apex (P) of the leading edge protruding portion extends forward in the fan rotating direction with respect to the apex (P). A radius (Rq) at a position of an apex (Q) of the trailing edge protruding portion is larger than a radius (Rp) at a position of the apex (P). The radius (Rq) at the position of the apex (Q) is larger than an intermediate radius (Rm) between a radius (Ro) of an outer peripheral edge and a radius (Ri) of an inner peripheral edge.

17 Claims, 15 Drawing Sheets

(51) Int. Cl.

| | |
|---|---|
| ***F04D 25/02*** | (2006.01) |
| ***F04D 29/28*** | (2006.01) |
| ***F04D 29/42*** | (2006.01) |
| ***F04D 29/38*** | (2006.01) |

(52) U.S. Cl.
CPC ..... *F04D 29/384* (2013.01); *F04D 29/4226* (2013.01); *F05D 2240/304* (2013.01)

(58) Field of Classification Search
USPC ..... 416/223 R, 236 R, 236 A
See application file for complete search history.

(56) References Cited

FOREIGN PATENT DOCUMENTS

| | | | |
|---|---|---|---|
| JP | 2002-054597 | A | 2/2002 |
| JP | 2002-357197 | A | 12/2002 |
| JP | 2003-065295 | A | 3/2003 |
| JP | 2003-083293 | A | 3/2003 |
| JP | 2007-024004 | A | 2/2007 |
| JP | 2007-218104 | A | 8/2007 |

* cited by examiner

PROPELLER FAN, AIR BLOWER, OUTDOOR UNIT

CROSS REFERENCE TO RELATED APPLICATION

This application is a U.S. national stage application of PCT/JP2013/083076 filed on Dec. 10, 2013, which claims priority to PCT/JP2012/083898 filed on Dec. 27, 2012, the contents of which are incorporated herein by reference.

TECHNICAL FIELD

The present invention relates to a propeller fan, an air blower, and an outdoor unit.

BACKGROUND ART

Hitherto, there have been proposed several examples of a blade shape of a propeller fan for realizing an air blower that achieves reduction in noise level and increase in efficiency. In order to achieve the reduction in noise level of the propeller fan, it is effective to reduce an rpm and necessary to accelerate rise of static pressure. Further, it is also necessary to suppress a turbulence of an air current, to thereby suppress fluctuation of pressure applied to blades.

For example, in Patent Literature 1, there is disclosed a blade including a protruding portion formed on a trailing edge portion of the blade to protrude in a direction reverse to a rotating direction of the blade so that the blade area is increased, thereby increasing a degree of rise of static pressure. Further, in Patent Literature 2, there is disclosed a blade including a recessed portion formed in a region of a leading edge portion close to a boss to be recessed in a rotating direction so that the area covered by an air current passing along the boss side is increased, and further including a protruding portion formed in a region of a trailing edge portion close to the boss to protrude in a direction reverse to the rotating direction.

CITATION LIST

Patent Literature

[PTL 1] JP 2007-024004 A (FIG. 1, FIG. 3)
[PTL 2] JP 2002-54597 A (FIG. 1, Table 1)

SUMMARY OF INVENTION

Technical Problems

In general, when a radial difference becomes larger in an air velocity distribution and a static pressure distribution of an air current that has just passed between the blades, the amount of the air may become insufficient due to an air current (secondary flow) flowing in a direction different from an intended flowing direction, or noise level may be increased and efficiency may be reduced due to occurrence of a vortex.

More specifically, the propeller fan has a large blade area on an outer peripheral side thereof, and hence a degree of rise of static pressure is high in an air current passing along an outer peripheral portion. However, the blade area covered by an air current passing along an inner peripheral side is small, and hence the degree of rise of static pressure is low in the air current passing along the inner peripheral side.

Further, on the inner peripheral side and an upstream side of each of the blades, a boss is arranged to fix together the blades and a motor serving as a driving source. When the air current passes along the boss, a turbulent air current generated due to occurrence of a vortex, or a turbulent air current locally increased in velocity flows into the blades. Accordingly, the air current is easily separated at the leading edge portion of each of the blades, and the static pressure does not rise until the separated air current starts flowing along a blade surface (until the separated air current is re-adhered), which reduces the degree of rise.

As described above, the air current passing along the inner peripheral side has the above-mentioned two problems of the blade area and the flow separation, and hence the static pressure does not rise easily. When a difference is caused in degree of rise of the static pressure between the outer peripheral side and the inner peripheral side, a difference in static pressure is increased at an downstream portion of a fan, and the difference in static pressure causes the secondary flow, which may induce the insufficiency of the amount of the air and a vortex, thereby leading to increase in noise level and increase of loss.

Further, in the technology disclosed in Patent Literature 1, the blade shape of the outer peripheral side, on which a moment is increased due to rotation, is improved, thereby achieving a high degree of rise of the static pressure of the air current passing along the outer peripheral side. The blade area covered by the air current passing along the inner peripheral side is relatively small, which may cause the secondary flow on a blowing side.

Further, in the technology disclosed in Patent Literature 2, the blade area is increased in each of the leading edge portion and the trailing edge portion, but the technology of Patent Literature 2 has the following problem. First, an air current flowing from the leading edge portion flows radially outward due to a centrifugal force. However, in the configuration of Patent Literature 2, the protruding portion of the trailing edge portion is formed on a radially inner peripheral portion close to the boss. Thus, the air current does not flow along the blade surface designed for increasing a passage distance, which may cause a risk in that the degree of rise of the static pressure cannot be ensured.

The present invention has been made in view of the above, and has an object to provide a propeller fan and the like capable of achieving reduction in noise level through increase in degree of rise of static pressure of an air current passing along an inner peripheral side and through reduction in rpm, suppressing a secondary flow through equalization of a static pressure distribution between an outer peripheral side and an inner peripheral side, and achieving reduction in noise level and increase in efficiency through prevention of reduction in amount of air and through suppression of a vortex.

Solution to Problems

In order to attain the above-mentioned object, according to one embodiment of the present invention, there is provided a propeller fan, including: a boss having a rotation axis; and a plurality of blades formed along an outer periphery of the boss, in which, in a shape obtained by projecting the propeller fan on a plane perpendicular to the rotation axis, a leading edge portion of the blade includes a leading edge protruding portion protruding backward in a fan rotating direction, and a trailing edge portion of the blade includes a trailing edge protruding portion protruding backward in the fan rotating direction, in which an inner peripheral side of the leading edge portion with respect to an apex P of the leading edge protruding portion extends forward in the fan rotating direction with respect to the apex P of the leading edge protruding portion, in which a radius Rq at a position of an apex Q of the trailing edge protruding portion is larger than a radius Rp at a position of the apex P of the leading edge protruding portion, and in which the radius Rq at the position of the apex Q of the trailing edge protruding portion is larger than an intermediate radius Rm between a radius Ro of an outer peripheral edge and a radius Ri of an inner peripheral edge of the blade.

Advantageous Effects of Invention

According to the one embodiment of the present invention, it is possible to achieve reduction in noise level through increase in degree of rise of the static pressure of the air current passing along the inner peripheral side and through reduction in rpm, suppress the secondary flow through equalization of the static pressure distribution between the outer peripheral side and the inner peripheral side, and to achieve reduction in noise level and increase in efficiency through prevention of reduction in amount of the air and through suppression of the vortex.

DESCRIPTION OF EMBODIMENTS

Figure 1:
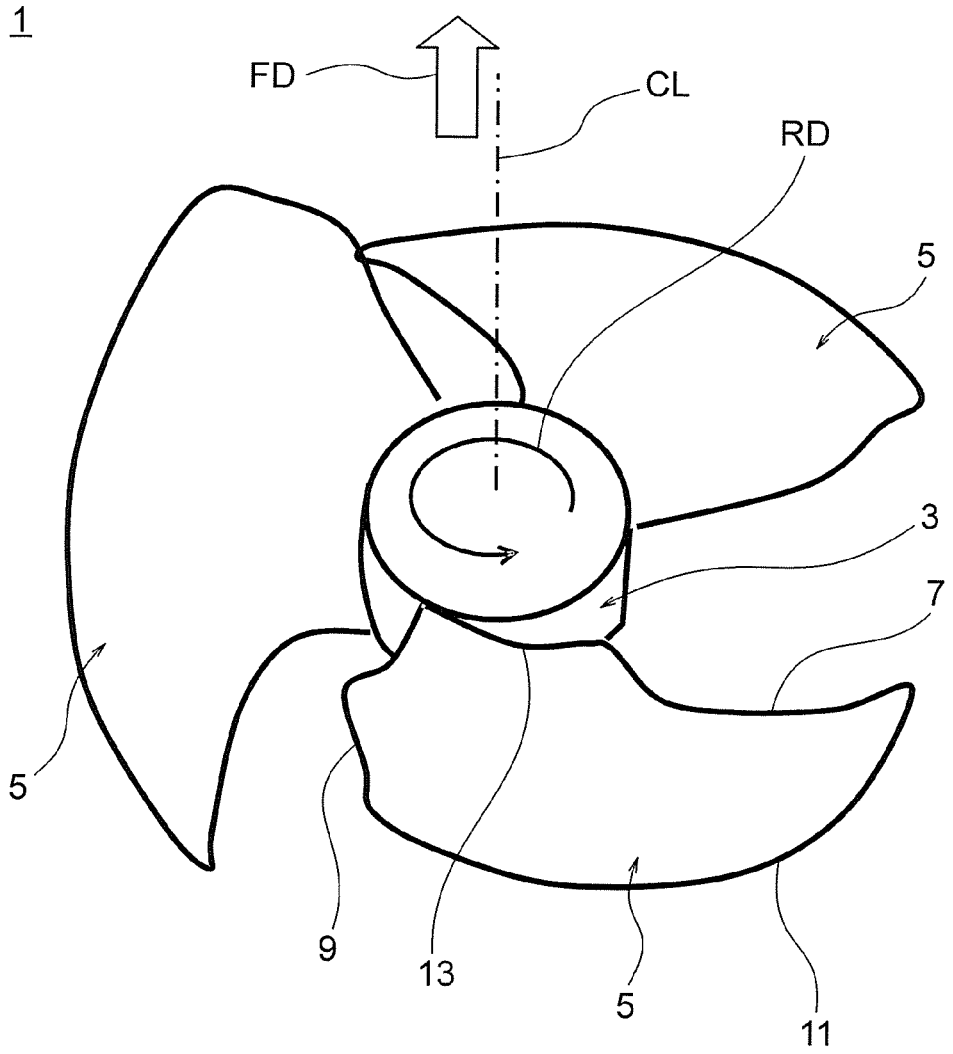
FIG. 1 is a view for illustrating a propeller fan according to a first embodiment of the present invention.

Now, a propeller fan according to embodiments of the present invention is described with reference to the accompanying drawings. Note that, in the drawings, the same reference symbols represent the same or corresponding parts.

First Embodiment

Figure 2:
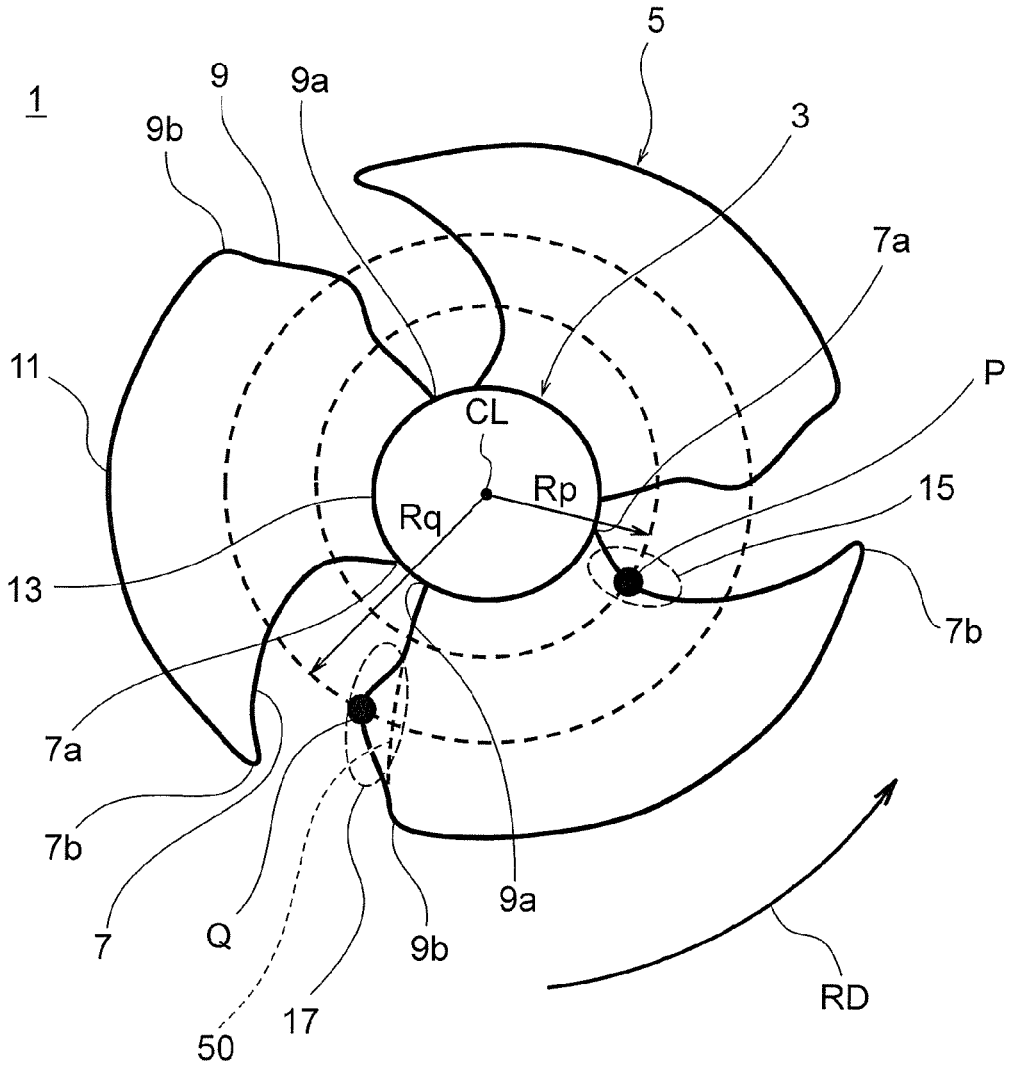
FIG. 2 is a view obtained by projecting the propeller fan according to the first embodiment on a plane perpendicular to a rotation axis of the propeller fan, for particularly illustrating radii Rp, Rq.
Figure 3:
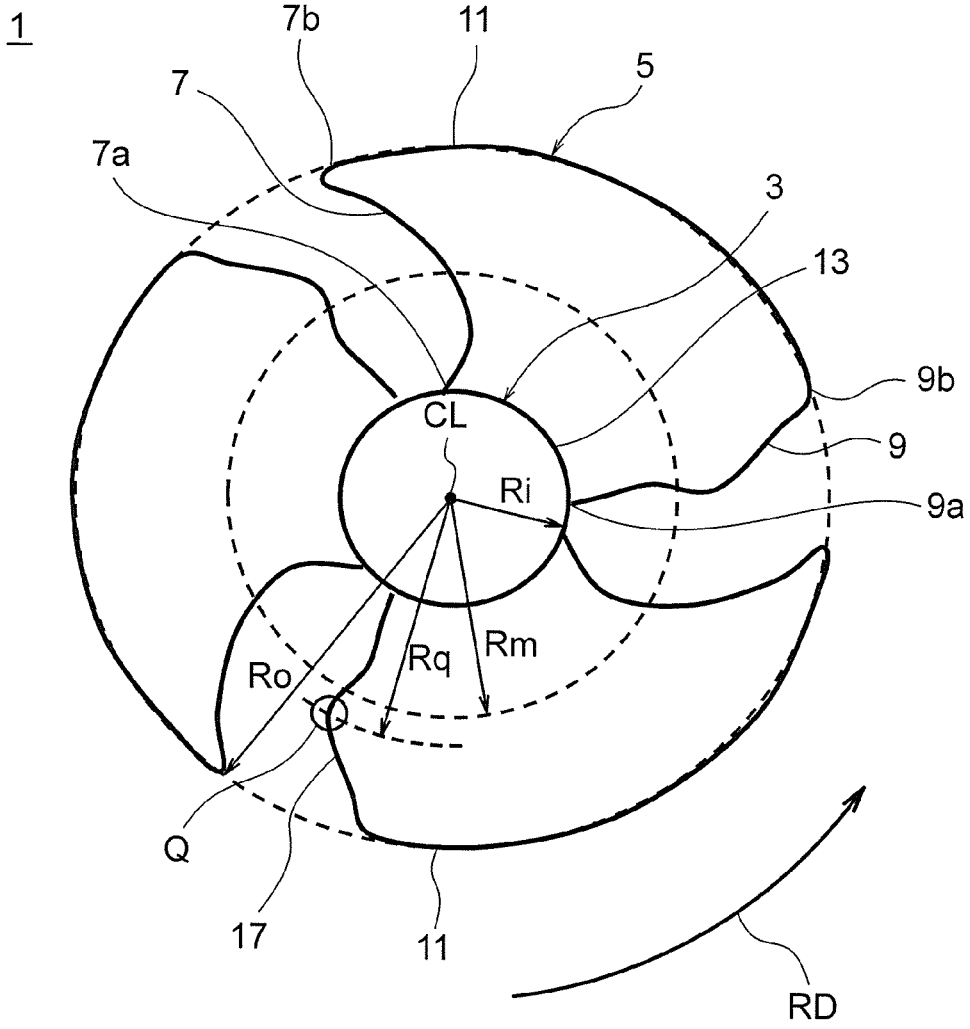
FIG. 3 is a view similar to FIG. 2, for particularly illustrating radii Ro, Rm.

FIG. 1 is a view for illustrating a propeller fan according to a first embodiment of the present invention. FIG. 2 and FIG. 3 are views obtained by projecting the propeller fan on a plane perpendicular to a rotation axis of the propeller fan. FIG. 2 is a view for particularly illustrating radii Rp, Rq, and FIG. 3 is a view for particularly illustrating radii Ro, Rm. A propeller fan 1 includes a boss 3 having a rotation axis CL, and a plurality of blades 5 formed along an outer periphery of the boss. The plurality of blades 5 extend from the boss 3 radially outward in a radiate manner, and are separated from each other equiangularly. Note that, in FIG. 1 to FIG. 3, the arrow RD indicates a fan rotating direction RD, and the arrow FD indicates an air-current flowing direction FD. Further, FIG. 1 to FIG. 3 exemplify a mode in which the number of the blades 5 is three, but the number of the blades 5 is not limited to three.

Each of the blades 5 includes a leading edge portion 7, a trailing edge portion 9, an outer peripheral edge 11, and an inner peripheral edge 13. The leading edge portion 7 is positioned on a forward side in the fan rotating direction RD. The leading edge portion 7 is connected to the boss 3 at an innermost peripheral portion **7*a* of the leading edge portion 7. The trailing edge portion 9 is positioned on a backward side in the fan rotating direction RD. The trailing edge portion 9 is connected to the boss 3 at an innermost peripheral portion 9*a* of the trailing edge portion 9. The inner peripheral edge 13 is a portion extending longitudinally in an arc-shaped manner between the innermost peripheral portion 7*a* of the leading edge portion 7 and the innermost peripheral portion 9*a* of the trailing edge portion 9. Each of the blades 5 is connected at the inner peripheral edge 13 to the outer periphery of the boss 3. Further, the outer peripheral edge 11 is a portion extending longitudinally in an arc-shaped manner to connect an outermost peripheral portion 7*b* of the leading edge portion 7 and an outermost peripheral portion 9*b* of the trailing edge portion 9 to each other. Note that, by way of example, in the first embodiment, the radius Ro of the outer peripheral edge 11 is uniform as illustrated in FIG. 3**.

As illustrated in FIG. 2 and FIG. 3, in a shape obtained by projecting the propeller fan on the plane perpendicular to the rotation axis CL of the fan, the leading edge portion 7 includes a leading edge protruding portion 15 protruding backward in the fan rotating direction RD. An apex P of the leading edge protruding portion 15 (most backward position of the leading edge protruding portion) is displaced from the innermost peripheral portion **7*a* of the leading edge portion 7, and is separated from the innermost peripheral portion 7*a*** radially outward. As circumferential positions, the innermost peripheral portion 7*a* and the outermost peripheral portion 7*b* of the leading edge portion 7 are positioned on the forward side in the fan rotating direction RD with respect to the apex P of the leading edge protruding portion 15. An inner peripheral side of the leading edge portion 7 with respect to the apex P of the leading edge protruding portion 15 extends forward in the fan rotating direction RD with respect to the apex P. That is, the leading edge portion 7 extends forward in the fan rotating direction RD from the apex P of the leading edge protruding portion 15 toward the innermost peripheral portion 7*a* as approaching the innermost peripheral portion 7*a*. Further, the leading edge portion 7 extends forward in the fan rotating direction RD from the apex P of the leading edge protruding portion 15 toward the outermost peripheral portion 7*b* as approaching the outermost peripheral portion 7*b*. The outermost peripheral portion 7*b* is positioned on the forward side in the fan rotating direction RD with respect to the innermost peripheral portion 7*a*.

In the shape obtained by projecting the propeller fan on the plane perpendicular to the rotation axis CL of the fan, the trailing edge portion 9 includes a trailing edge protruding portion 17 protruding backward in the fan rotating direction RD. That is, a region between the innermost peripheral portion 9*a* of the trailing edge portion 9 and the outermost peripheral portion 9*b* of the trailing edge portion 9 has a blade shape protruding backward in the fan rotating direction RD, and the trailing edge portion 9 having the blade shape includes the trailing edge protruding portion 17. Further detailed description is made below. As illustrated in FIG. 2, the trailing edge protruding portion 17 is a region further protruding backward in the fan rotating direction RD with respect to a convex trailing edge line 50 along which an entire region between the innermost peripheral portion 9*a* of the trailing edge portion 9 and the outermost peripheral portion 9*b* of the trailing edge portion 9 swells only backward in the fan rotating direction RD. An apex Q of the trailing edge protruding portion 17 (most backward position of the trailing edge protruding portion) is displaced from the innermost peripheral portion 9*a* of the trailing edge portion 9, and is separated from the innermost peripheral portion 9*a* radially outward. As circumferential positions, the innermost peripheral portion 9*a* and the outermost peripheral portion 9*b* of the trailing edge portion 9 are positioned on the forward side in the fan rotating direction RD with respect to the apex Q of the trailing edge protruding portion 17. Further, as illustrated in FIG. 2, as a circumferential position, the apex Q of the trailing edge protruding portion 17 is a portion positioned on a most backward side in the fan rotating direction RD in a region between the outermost peripheral portion 9*b* of the trailing edge portion 9 and the innermost peripheral portion 9*a* of the trailing edge portion 9 connected to the boss 3.

As illustrated in FIG. 2, the radius Rq at a position of the apex Q of the trailing edge protruding portion 17 is larger than the radius Rp at a position of the apex P of the leading edge protruding portion 15. In addition, as illustrated in FIG. 3, the radius Rq at the position of the apex Q of the trailing edge protruding portion 17 is larger than an intermediate radius Rm [Rm=(Ro+Ri)/2] between the radius Ro of the outer peripheral edge 11 and the radius Ri of the inner peripheral edge 13 of the blade 5. Note that, in the illustrated example, the apex P of the leading edge protruding portion 15 is positioned on a radially inner side with respect to the intermediate radius Rm. However, the first embodiment is not limited thereto, and may encompass a case where the radius Rp at the position of the apex P is larger than the intermediate radius Rm.

Figure 4:
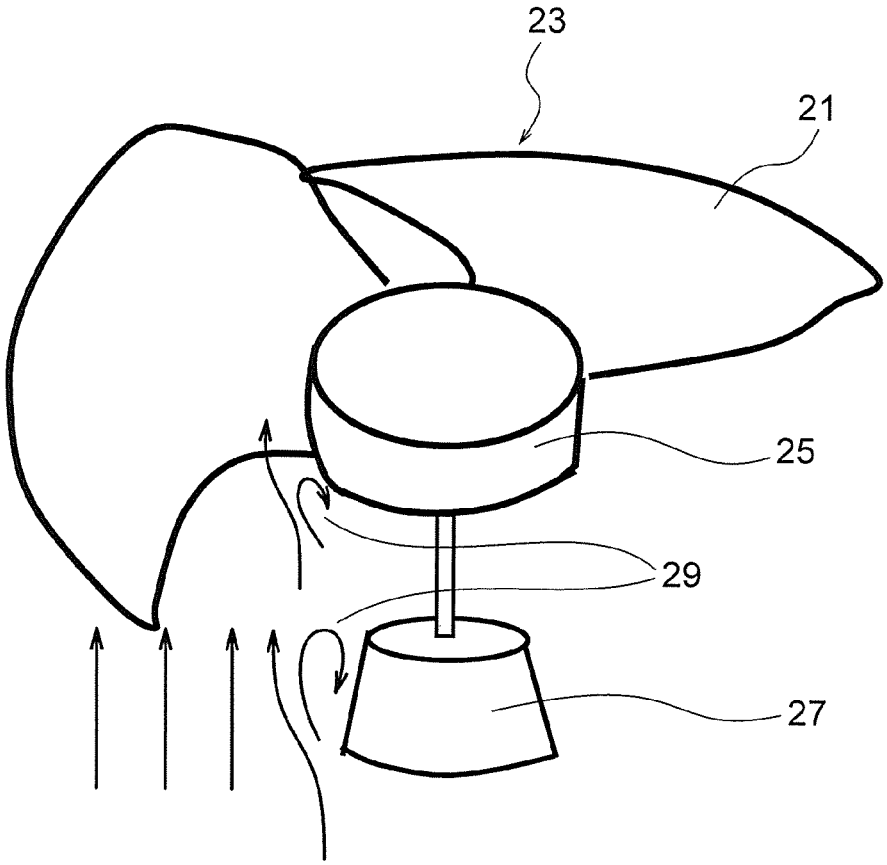
FIG. 4 is a view for illustrating, as an example for description, the propeller fan, a mechanism for driving the propeller fan, and a state of an air current.
Figure 5:
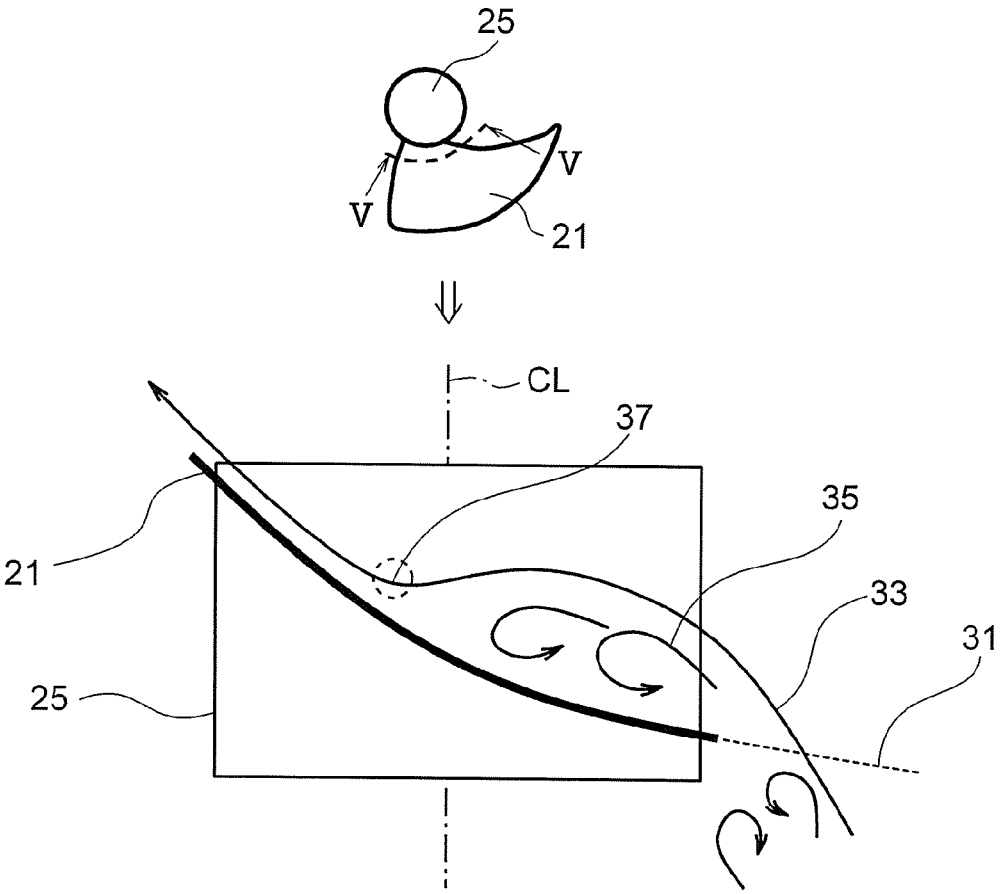
FIG. 5 is a view taken along the line V-V, for illustrating the propeller fan as an example for description and illustrating an air current flowing in the vicinity of a blade.

Next, operation of the blades according to the first embodiment is described. First, description as a premise is made. FIG. 4 is a view for illustrating, for description as a premise, the propeller fan, a mechanism for driving the propeller fan, and a state of an air current. Further, FIG. 5 is a view taken along the line V-V, for illustrating an air current flowing in a vicinity of the blade. In FIG. 4 and FIG. 5, for convenience of description, an illustration of a part of the blade is omitted, and an illustration of a cross-section of the blade is also simplified (illustration of the cross-section of the blade is also simplified in FIG. 6).

As illustrated in FIG. 4 as an example for description, a boss 25 of a propeller fan 23 including blades 21 is mounted to a fan motor 27 exemplified as a driving source, and is rotated by a rotational force of the fan motor 27. Rotation of the fan motor 27 causes an air current to flow from a leading edge portion of the blade 21 so as to be discharged from a trailing edge portion thereof after passing between the blades. When flowing along the blade, the air current passing between the blades is changed in direction due to an inclination and a camber of the blade, and static pressure rises due to a change of momentum. Here, description is made of an air current flowing into an inner peripheral portion in the vicinity of the boss 25. On an upstream side of the inner peripheral side of the blade, the cylindrical boss and the fan motor are arranged. Accordingly, the air current immediately before flowing into the leading edge of the blade includes a turbulent air current 29 having irregular air velocity because a vortex occurs when a fluid passes along the fan motor and the boss, and because a high-velocity air current is locally generated when the fluid passes through a flow passage that is narrowed due to presence of the fan motor, presence of the boss, or presence of the vortex.

When this problem is illustrated using the direction in FIG. 5 as a reference, a direction 31 of the leading edge portion of the blade on the inner peripheral side (tangential direction of the leading edge portion in the cross-section of the blade) does not conform to a direction 33 of the air current flowing into the leading edge portion, thereby causing flow separation 35 in the leading edge portion. The separated air current re-adheres to a blade surface (illustrated as a re-adhesion point 37) due to a sucking force of the vortex occurring in the leading edge portion. After the re-adhesion, the air current flows along the blade surface, and the static pressure rises. However, when separation is caused, the blade area effective in rise of the static pressure is reduced.

On the other hand, in the air current passing along an outer peripheral side, no resisting object causing a turbulence is present in an upstream region. Accordingly, the air current flows from the leading edge portion along the blade surface, and hence the static pressure easily rises. In addition, the radius is large in an outer peripheral region, and a moment in the outer peripheral region is larger than that in an inner peripheral region. Accordingly, in the existing propeller fan, the air current on the inner peripheral side and the air current on the outer peripheral side have a large difference in degree of increase of the static pressure, thereby easily causing a secondary flow due to the difference in static pressure.

Figure 6:
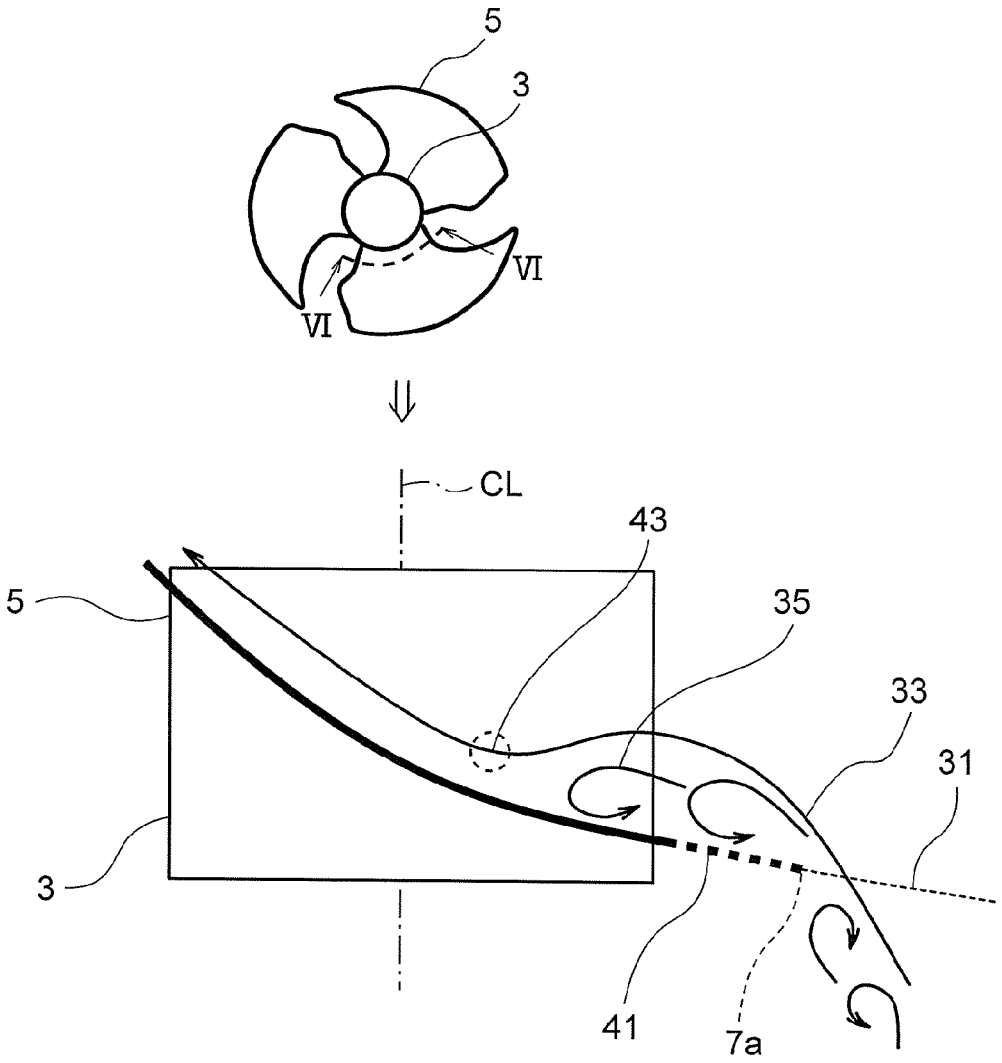
FIG. 6 is a view taken along the line VI-VI, for illustrating an air current flowing in the vicinity of the blade according to the first embodiment.

By contrast, in the first embodiment, the following air current can be obtained. FIG. 6 is a view taken along the line VI-VI, for illustrating an air current flowing in the vicinity of the blade. In the first embodiment, as described above, on the inner peripheral side with respect to the apex P of the leading edge protruding portion 15, there is a region positioned on the forward side in the fan rotating direction RD with respect to the apex P (region indicated by the broken line 41 of FIG. 6). Thus, although the flow separation 35 is caused, a re-adhesion point 43 following the flow separation can be obtained on the upstream side of the air current (position close to the leading edge portion 7 of the blade 5), with the result that it is possible to increase a distance from the re-adhesion point of the air current to the trailing edge. In this manner, a distance covered by the air current flowing along the blade can be increased, and a high degree of rise of the static pressure can be achieved in the air current flowing on the inner peripheral side.

Further, the air current having a strong turbulence is more liable to be generated in a region closer to the boss, and the distance from the separation to the re-adhesion point is increased. By contrast, the leading edge portion 7 according to the first embodiment extends forward in the fan rotating direction RD from the apex P of the leading edge protruding portion 15 toward the innermost peripheral portion 7*a* as approaching the innermost peripheral portion 7*a*. Accordingly, it is possible to equalize the degree of rise of the static pressure in a radial direction of the blades 5.

Figure 7:
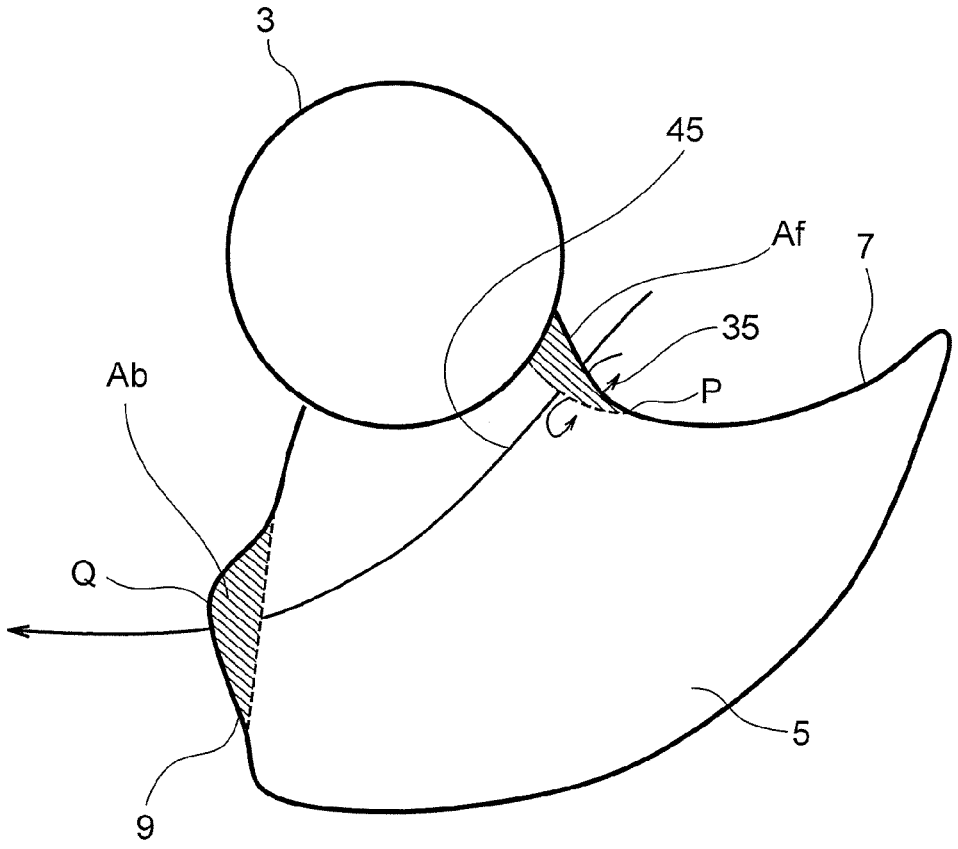
FIG. 7 is a view for illustrating a state of an air current passing along a blade surface, which is obtained based on an air current analysis.

Further, in the first embodiment, the radius Rq at the position of the apex Q of the trailing edge protruding portion 17 is larger than the intermediate radius Rm between the radius Ro of the outer peripheral edge 11 and the radius Ri of the inner peripheral edge 13 of the blade 5, thereby being capable of attaining the following advantage. FIG. 7 is an illustration of a state of an air current passing along the blade surface, which is obtained based on an air current analysis. Note that, for convenience of description, FIG. 7 is an illustration of only one blade, and an illustration of the other blades is omitted (the same holds true in FIG. 8 described later).

As illustrated in FIG. 7, an air current 45 flowing from the inner peripheral side of the leading edge portion 7 flows toward the trailing edge portion 9 while being moved radially outward due to a centrifugal force. Although there is a slight difference depending on fan operation conditions such as an amount of the air and pressure, in general, the air current flowing from the inner peripheral side with respect to the vicinity of the apex P tends to pass along the trailing edge portion 9 at a position of the intermediate radius Rm or on a radially outer side with respect to the position of the intermediate radius Rm. By contrast, in the first embodiment, as described above, the radius Rq at the position of the apex Q of the trailing edge protruding portion 17 is larger than the intermediate radius Rm. Thus, this configuration can elongate a passage of the air current passing along the inner peripheral side, and can further increase the degree of rise of the static pressure of the air current passing along the inner peripheral side. That is, the air current 45, which flows from the inner peripheral side of the leading edge portion 7, passes along a region Af (where the inner peripheral side of the leading edge portion with respect to the apex of the leading edge protruding portion extends forward in the fan rotating direction with respect to the apex), and passes along a region Ab (where the radius Rq at the position of the apex Q is larger than the radius Rp at the position of the apex P and larger than the intermediate radius Rm). Thus, the passage of the passing air current can be further elongated, and the degree of rise of the static pressure can be further increased.

According to the first embodiment having the above-mentioned configuration, in the shape obtained by projecting the propeller fan on the plane perpendicular to the rotation axis, the protruding portion protruding backward is formed on each of the leading edge portion and the trailing edge portion, and the inner peripheral side of the leading edge portion with respect to the apex of the leading edge protruding portion extends forward in the fan rotating direction with respect to the apex. Further, the radius at the position of the apex of the trailing edge protruding portion is larger than the radius at the position of the apex of the leading edge protruding portion, and the radius at the position of the apex of the trailing edge protruding portion is larger than the intermediate radius. Accordingly, it is possible to increase the degree of rise of the static pressure of the air current passing along the inner peripheral side, and to achieve reduction in noise level through reduction in rpm. Further, it is possible to suppress the secondary flow through equalization of a static pressure distribution between the outer peripheral side and the inner peripheral side, and to achieve reduction in noise level and increase in efficiency through prevention of reduction in amount of the air and through suppression of the vortex. Further, with reference to FIG. 8, description is made of equalization of the static pressure distribution between the outer peripheral side and the inner peripheral side. The region Af is formed on the leading edge portion 7, and the region Ab is formed on the trailing edge portion 9. With this configuration, as compared to a mode that does not have the regions Af, Ab, the degree of rise of the static pressure of the air current 45 passing along the inner peripheral side, and the degree of rise of the static pressure of an air current 47 passing along the outer peripheral side are equalized, thereby reducing a difference between static pressure 91 and static pressure P2 after the air is blown from the blade 5. Consequently, a radial secondary flow can be reduced.

Second Embodiment

Figure 9:
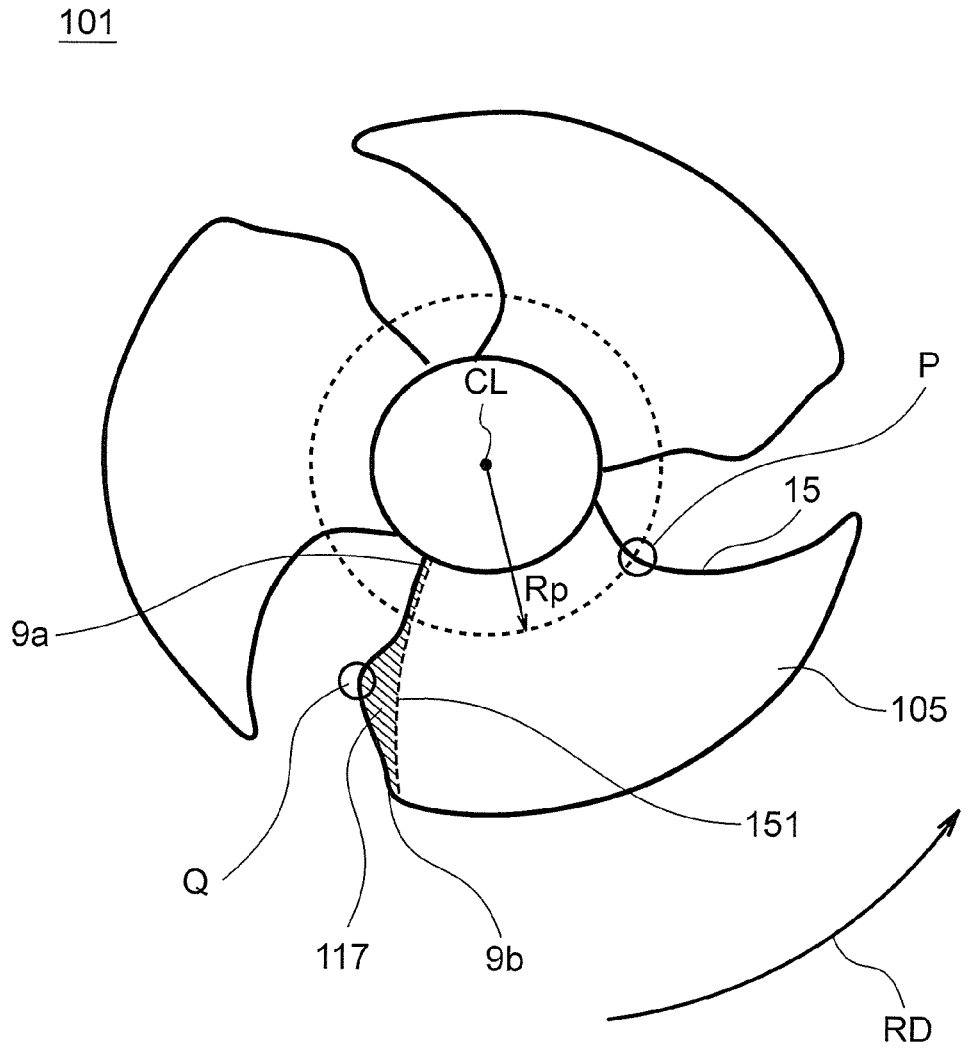
FIG. 9 is a view similar to FIG. 2 according to a second embodiment of the present invention.

Next, a second embodiment of the present invention is described. The second embodiment is similar to the above-mentioned first embodiment except for a matter described below. FIG. 9 is a view similar to FIG. 2 according to the second embodiment.

As illustrated in FIG. 9, a trailing edge protruding portion 117 of a trailing edge portion 9 of each blade 105 of a propeller fan 101 according to the second embodiment protrudes backward in the fan rotating direction RD with respect to a trailing edge reference line 151. An entire region of the trailing edge protruding portion 117 is positioned on the radially outer side with respect to the radius Rp at the position of the apex P of the leading edge protruding portion. The trailing edge reference line 151 is a line connecting the innermost peripheral portion 9*a* and the outermost peripheral portion 9*b* of the trailing edge portion 9 to each other, and is also a curved line gradually extending in the fan rotating direction RD from the innermost peripheral portion 9*a* toward the outermost peripheral portion 9*b*. Asa specific example, the trailing edge reference line 151 is a line connecting the innermost peripheral portion 9*a* and the outermost peripheral portion 9*b* to each other, and is also an arc line extending along the trailing edge portion 9 as much as possible and having a uniform radius of curvature. Note that, the trailing edge reference line 151 may correspond to the above-mentioned convex trailing edge line 50 according to the first embodiment.

As described above, until reaching the trailing edge, the air current flowing from the vicinity of the apex P of the leading edge protruding portion 15 flows while being moved radially outward due to the centrifugal force. Accordingly, in the second embodiment, the trailing edge protruding portion 117 for elongating the passage of the air current is arranged on the radially outer side with respect to the apex P. In this manner, similarly to the first embodiment, it is possible to achieve reduction in noise level through increase in degree of rise of the static pressure and through reduction in rpm, suppress the secondary flow through equalization of the static pressure distribution between the outer peripheral side and the inner peripheral side, and to achieve reduction in noise level and increase in efficiency through prevention of reduction in amount of the air and through suppression of the vortex.

Note that, in the second embodiment, it is not essential that the radius Rq at the position of the apex Q of the trailing edge protruding portion be larger than the intermediate radius Rm. That is, in addition to adopting the configuration in which the radius Rq at the position of the apex Q is larger than the intermediate radius Rm similarly to the above-mentioned first embodiment, the entire region of the trailing edge protruding portion 117 of the trailing edge protruding portion 117 may be positioned on the radially outer side with respect to the radius Rp at the position of the apex P of the leading edge protruding portion. Alternatively, although the radius Rq itself at the position of the apex Q is smaller than the intermediate radius Rm, the entire region of the trailing edge protruding portion 117 may be still positioned on the radially outer side with respect to the radius Rp at the position of the apex P of the leading edge protruding portion.

Third Embodiment

Figure 10:
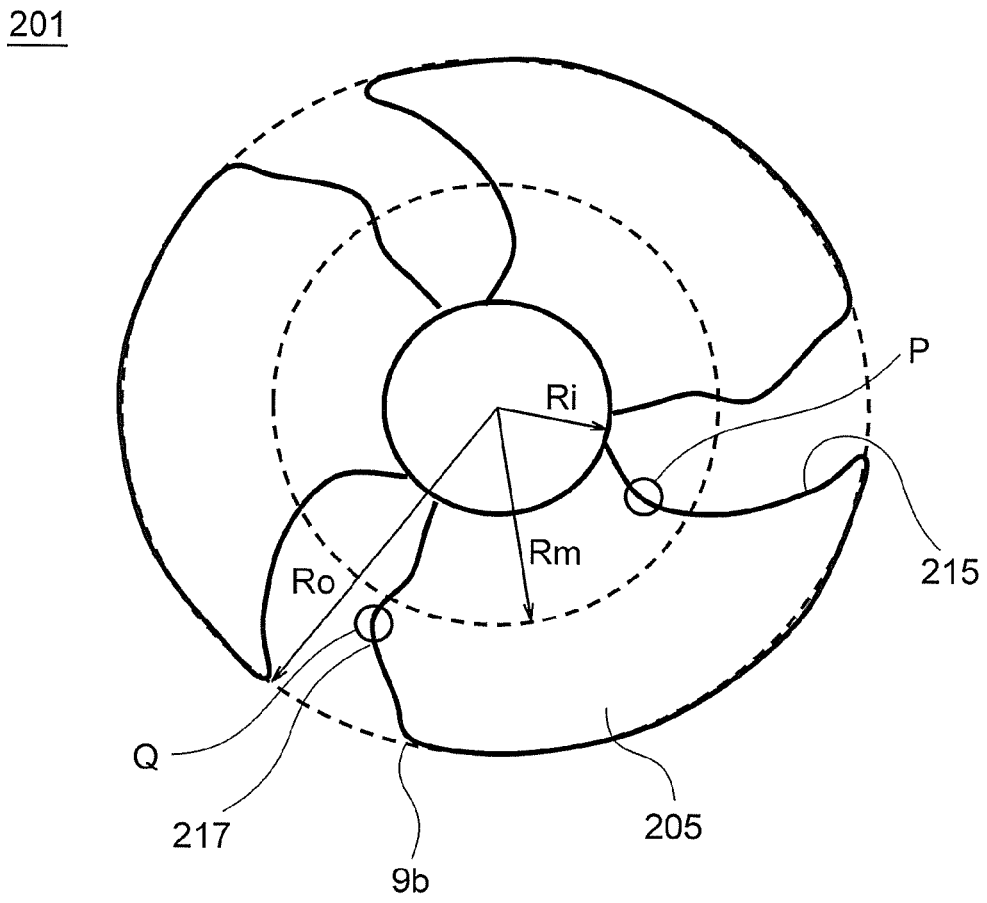
FIG. 10 is a view similar to FIG. 2 according to a third embodiment of the present invention.

Next, a third embodiment of the present invention is described. The third embodiment is similar to the above-mentioned first embodiment except for a matter described below. FIG. 10 is a view similar to FIG. 2 according to the third embodiment.

As described above, the passage of the air passing along the blade surface is elongated, thereby being capable of increasing the degree of rise of the static pressure of the air current. However, when elongating the passage of the air that passes along the blade surface after flowing from the outer peripheral side of the leading edge portion or from the vicinity of a radial middle position of the leading edge portion, the passage of the air current passing toward the outer peripheral side of the trailing edge is enlarged. As a result, there may be caused a fear in that the static pressure distribution in the radial direction is intensified at a blade outlet. Accordingly, in a blade 205 of a propeller fan 201 according to the third embodiment, a radius Rp at a position of an apex P of a leading edge protruding portion 215 is smaller than the intermediate radius Rm, in other words, the apex P is arranged on the radially inner side with respect to the intermediate radius Rm. Further, the same is true of elongating, through use of the trailing edge portion, the passage of the air current passing along the blade surface. In the third embodiment, an apex Q of a trailing edge protruding portion 217 is displaced from the outermost peripheral portion 9*b* of the trailing edge portion, and is separated from the outermost peripheral portion 9*b* radially inward.

According to the third embodiment having the above-mentioned configuration, while suppressing enlargement of the passage of the air current passing along the outer peripheral side of the trailing edge, the degree of rise of the static pressure on the inner peripheral side is increased. Thus, reduction in noise level and increase in efficiency can be achieved further ideally.

Figure 8:
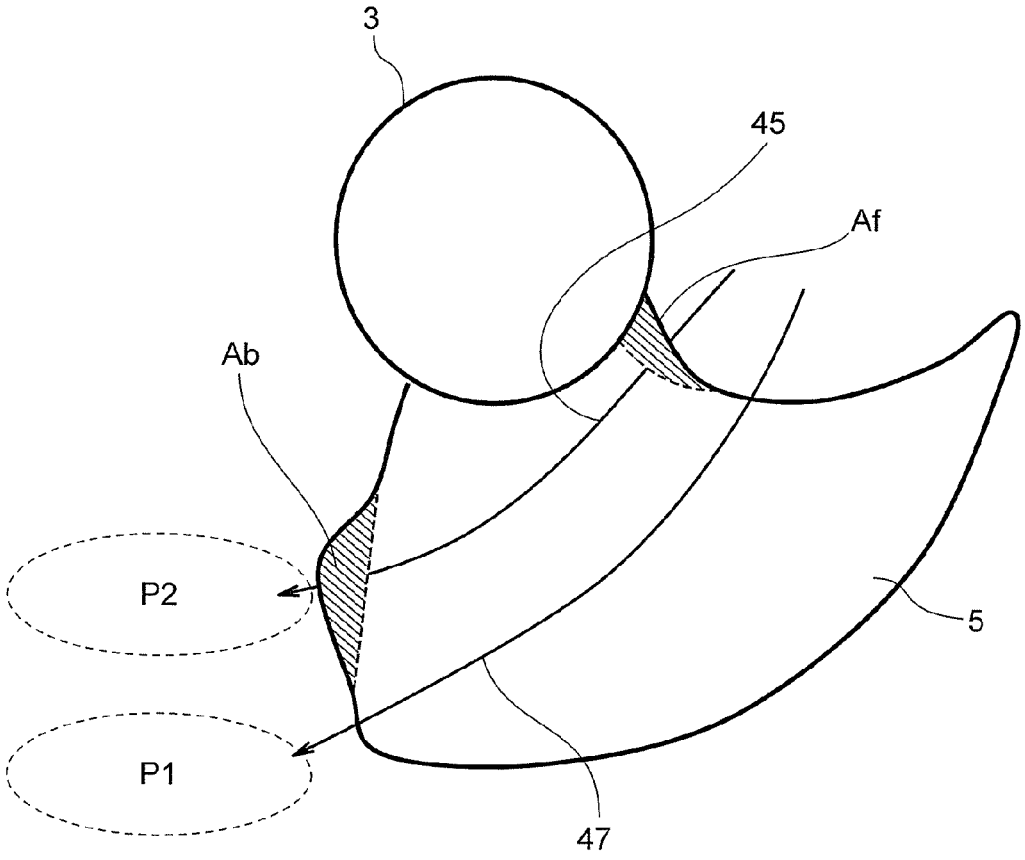
FIG. 8 is a view similar to FIG. 7, for illustrating an air current on an inner peripheral side and an air current on an outer peripheral side.
Figure 11:
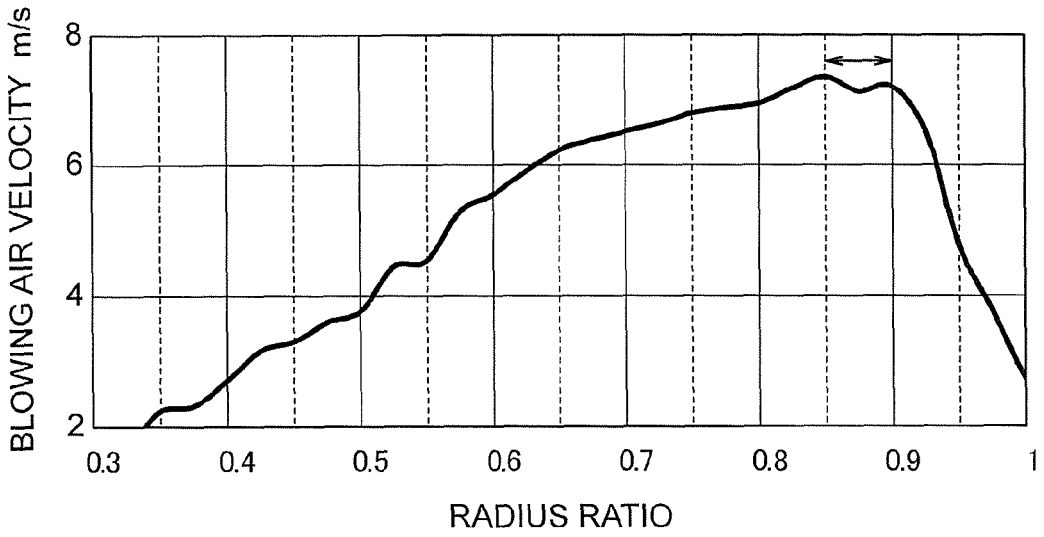
FIG. 11 is a graph for showing an example of a blowing air velocity distribution of a propeller fan according to Comparative Example.

Here, FIG. 11 is a graph for showing, as Comparative Example, an example of a blowing air velocity distribution of a propeller fan including blades without the regions Af, Ab hatched in FIG. 7 and FIG. 8. A vertical axis shows blowing air velocity of a fan having a radius of 200 mm, and a horizontal axis shows a radius ratio. Note that, the radius ratio refers to a dimensionless quantity showing a ratio of a radial position R (mm) of a circle having the rotation axis CL as a center to the radius Ro (mm) of the outer peripheral edge (radius ratio=[R]/[Ro]). In this example, a radius of the boss, that is, a radial position at the inner peripheral edge of the blade is 30% of the radius Ro of the outer peripheral edge. In other words, a point of 0.3 shown in FIG. 11 corresponds to an outer peripheral portion of the boss (at a position of the inner peripheral edge). Further, a point of 1.0 shown in FIG. 11 corresponds to a position of the outer peripheral edge itself. As shown in FIG. 11, in the blade without the hatched regions Af, Ab, a region where the blowing air velocity is highest is seen around 85% to 90% of the radius Ro of the outer peripheral edge. The air velocity tends to reduce when the radius ratio is 85% or less. Accordingly, as a specific mode of the third embodiment, a radius at the position of the apex Q of the trailing edge protruding portion 217 is set to be smaller than 85% of the radius Ro of the outer peripheral edge of the blade 205. In other words, the apex Q is arranged on the radially inner side with respect to a position of 85% of the radius Ro from the rotation axis CL. In this manner, the static pressure distribution in the radial direction can be equalized while increasing the air velocity on the inner peripheral side.

Fourth Embodiment

Figure 12:
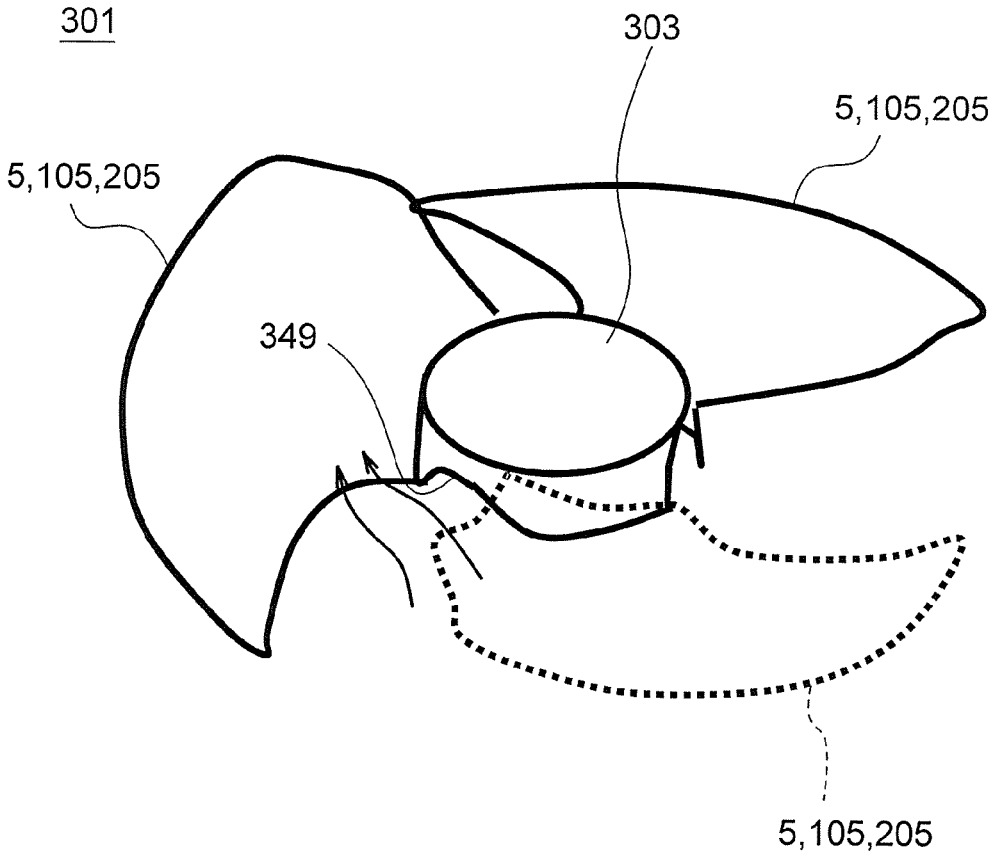
FIG. 12 is a perspective view for illustrating a propeller fan according to a fourth embodiment of the present invention.
Figure 13:
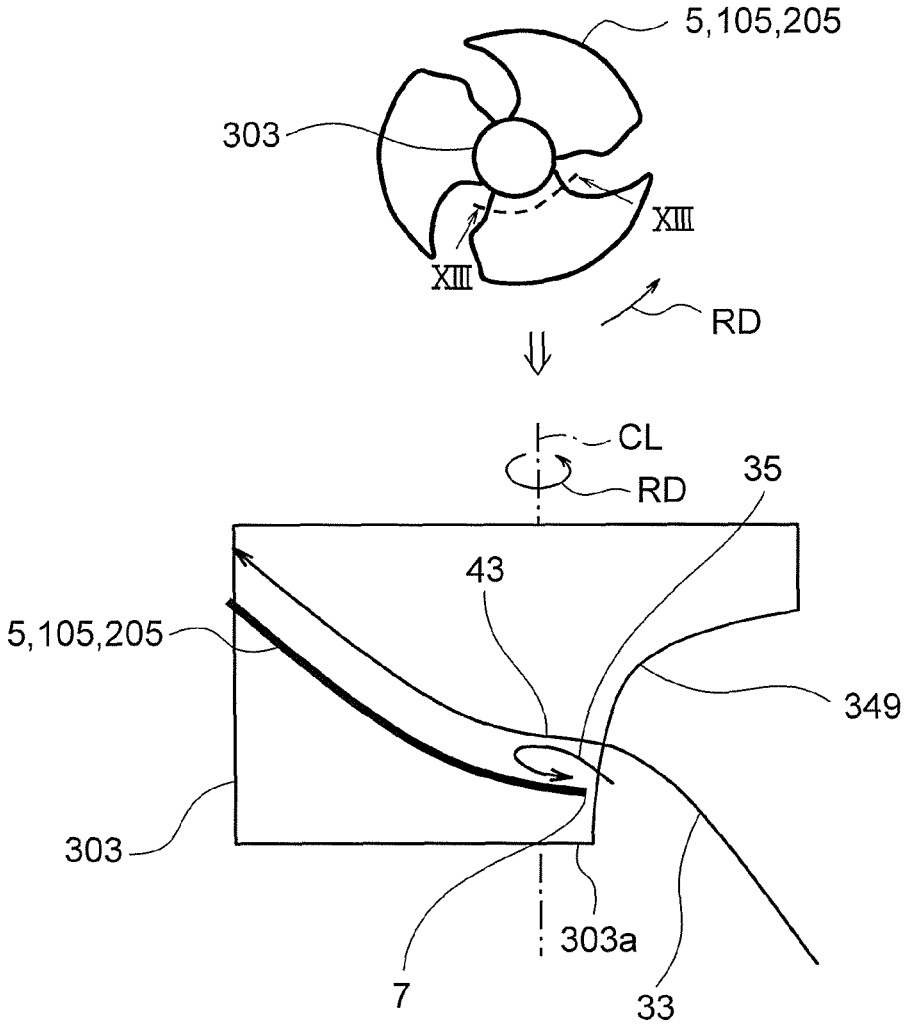
FIG. 13 is a view taken along the line XIII-XIII, for illustrating cutouts of a boss and a state of an air current flowing in the vicinity of the blade according to the fourth embodiment of the present invention.

Next, a fourth embodiment of the present invention is described. The fourth embodiment is similar to the above-mentioned first embodiment except for a matter described below. FIG. 12 is a perspective view for illustrating a propeller fan according to the fourth embodiment. Further, FIG. 13 is a view similar to FIG. 6 and taken along the line XIII-XIII, for illustrating cutouts of a boss and a state of an air current flowing in the vicinity of a blade according to the fourth embodiment.

A propeller fan 301 according to the fourth embodiment includes any one of the blades 5, the blades 105, and the blades 205 according to the first to third embodiments, and a boss 303 for supporting the blades. The boss 303 has a cylindrical side wall, and a plurality of cutouts 349 are formed in the side wall.

Each of the cutouts 349 is formed in an upstream region of the side wall of the boss 303 in the flowing direction FD, and in a region between the leading edge portion 7 of the corresponding blade and the trailing edge portion 9 of the adjacent blade positioned on the forward side in the fan rotating direction RD. More specifically, the cutout 349 is formed to exhibit a shape extending from an upstream end 303*a* of the side wall of the boss 303 to the leading edge portion 7 of the blade, approaching, from the leading edge portion 7, the trailing edge portion 9 of the adjacent blade positioned on the forward side in the fan rotating direction RD, and finally extending from the trailing edge portion 9 to the upstream end 303*a*.

In the propeller fan 301 described above, the cutouts 349 are formed, thereby suppressing a slipstream and a vortex, which may occur when the air current passes along the boss. Thus, it is possible to suppress a high-velocity local air current. Accordingly, a turbulence flowing into the leading edge portion is reduced, and a turbulence of the air current generated at the leading edge portion of the blade is reduced, with the result that a degree of the separation 35 is reduced at the leading edge portion. Accordingly, the air current flowing into the inner peripheral side of the blade covers a reduced distance from the separation to the re-adhesion point 43, and hence a distance covered by the air current flowing along the blade is further increased as compared to those of the above-mentioned embodiments, thereby increasing the degree of rise of the static pressure. As a result, reduction in noise level and increase in efficiency can be further achieved.

Fifth Embodiment

As described above, the present invention relates to increase in efficiency of the propeller fan and reduction in noise level thereof. When the fan is mounted onto an air blower, an air blowing rate can be increased at high efficiency. When the fan is mounted onto an air conditioner or a hot-water supply outdoor unit, which is a refrigeration cycle system including a compressor, a heat exchanger, and the like, a large amount of the air passing through the heat exchanger can be achieved with reduced noise level and at high efficiency. In this manner, it is possible to realize reduction in noise level of the apparatus and energy saving. A seventh embodiment of the present invention describes, as an example of the above-mentioned fan, a case where any one of the propeller fans according to the first to fourth embodiments is applied to an outdoor unit for an air conditioner, which serves as an outdoor unit including an air blower.

Figure 14:
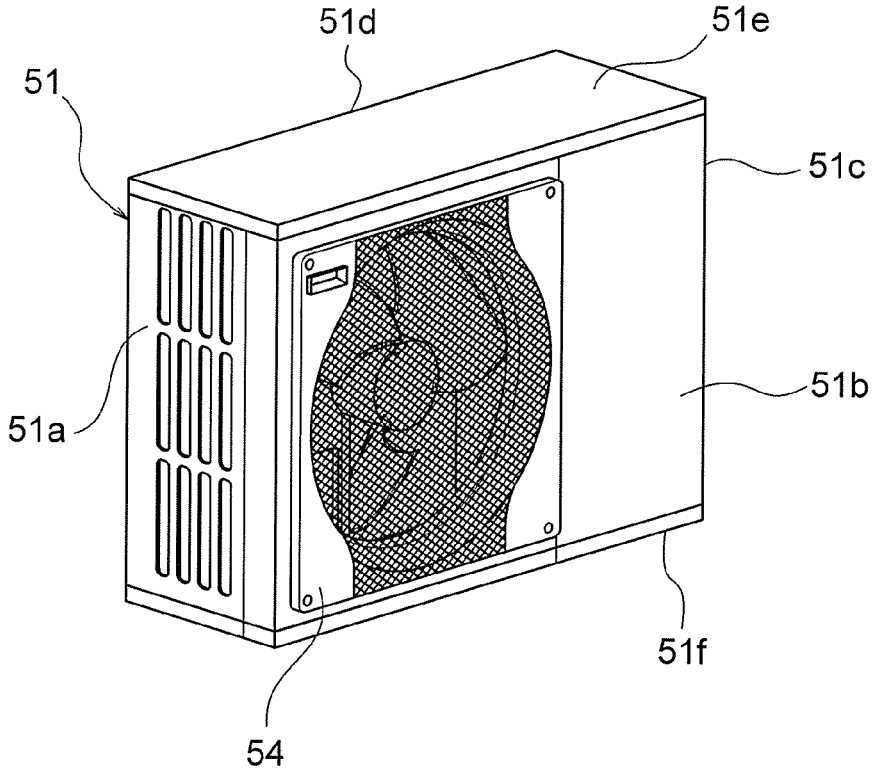
FIG. 14 is a perspective view for illustrating an outdoor unit according to a fifth embodiment of the present invention as viewed from an air outlet side thereof.
Figure 15:
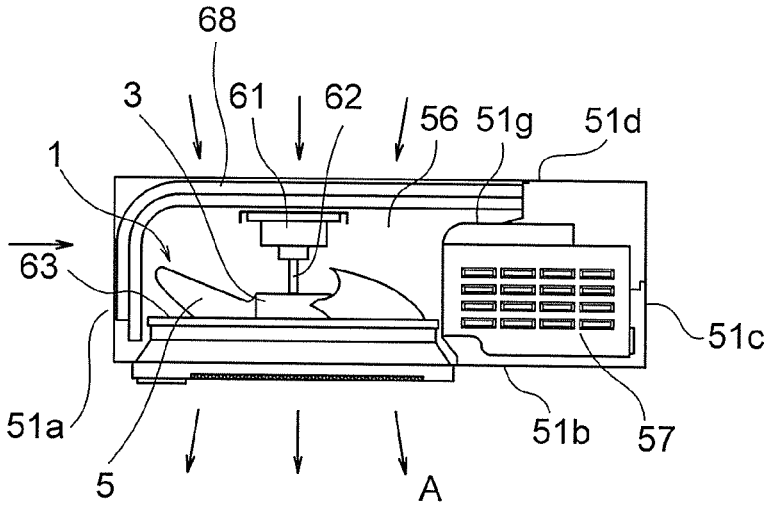
FIG. 15 is a view for illustrating a configuration of the outdoor unit according to the fifth embodiment as viewed from atop surface side thereof.
Figure 16:
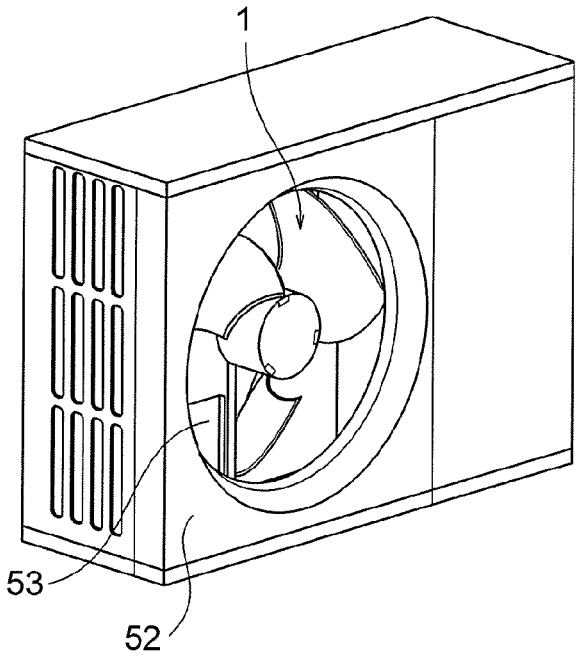
FIG. 16 is a view for illustrating a state in which a fan grille is removed according to the fifth embodiment.
Figure 17:
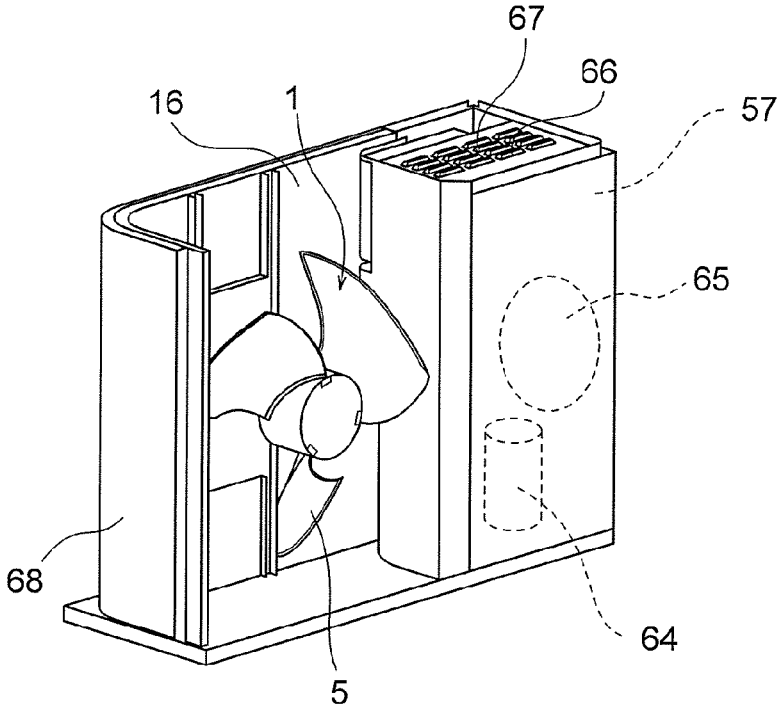
FIG. 17 is a view for illustrating an internal configuration in a state in which a front panel and the like are further removed according to the fifth embodiment.

FIG. 14 is a perspective view for illustrating an outdoor unit (air blower) according to a fifth embodiment of the present invention as viewed from an air outlet side thereof, and FIG. 15 is a view for illustrating a configuration of the outdoor unit as viewed from a top surface side thereof. Further, FIG. 16 is an illustration of a state in which a fan grille is removed, and FIG. 17 is a view for illustrating an internal configuration in a state in which a front panel and the like are further removed. Note that, FIGS. 14 to 17 are illustrations of, as a representative example, the propeller fan 1 according to the first embodiment, but the fifth embodiment is not limited thereto. The propeller fans according to the second to fourth embodiments are also applicable.

As illustrated in FIGS. 14 to 17, an outdoor-unit main body (casing) 51 is formed as a casing including a pair of right and left side surfaces 51*a*, 51*c*, a front surface 51*b*, a back surface 51*d*, a top surface 51*e*, and a bottom surface 51*f*. The side surface 51*a* and the back surface 51*d* each have an opening portion through which the air is sucked from an outside (see the arrows A of FIG. 15). Further, in a front panel 52 of the front surface 51*b*, an air outlet 53 is formed as an opening portion through which the air is blown out to the outside (see the arrows A of FIG. 12). In addition, the air outlet 53 is covered with a fan grille 54. This configuration prevents contact between an object, etc. and the propeller fan 1, to thereby assure safety.

The propeller fan 1 is mounted in the outdoor-unit main body 51. The propeller fan 1 is connected to a fan motor (driving source) 61 on the back surface 51*d* side through intermediation of a rotation shaft 62, and is rotated and driven by the fan motor 61.

An inside of the outdoor-unit main body 51 is partitioned by a partition plate (wall) 51*g* into an air-blowing chamber 56 in which the propeller fan 1 is housed and mounted, and a machine chamber 57 in which a compressor 64 and the like are mounted. On the side surface 51*a* side and the back surface 51*d* side in the air-blowing chamber 56, a heat exchanger 68 extending in substantially an L-shape in plan view is arranged.

A bellmouth 63 is arranged on a radially outer side of the propeller fan 1 arranged in the air-blowing chamber 56. The bellmouth 63 is positioned on an outer side of the outer peripheral edge of each of the blades 5, and exhibits an annular shape along the rotating direction of the propeller fan 1. Further, the partition plate 51*g* is positioned on one side of the bellmouth 63 (on a right side in the drawing sheet of FIG. 15), and a part of the heat exchanger 68 is positioned on another side (opposite side) thereof (on a left side in the drawing sheet of FIG. 15).

A front end of the bellmouth 63 is connected to the front panel 52 of the outdoor unit to surround an outer periphery of the air outlet 53. Note that, the bellmouth 63 may be formed integrally with the front panel 52, or may be prepared as a separate component to be connected to the front panel 52. Due to the bellmouth 63, a flow passage between an air inlet side and an air outlet side of the bellmouth 63 is formed as an air passage in the vicinity of the air outlet 53. That is, the air passage in the vicinity of the air outlet 53 is partitioned by the bellmouth 63 from another space in the air-blowing chamber 56.

The heat exchanger 68 arranged on the air inlet side of the propeller fan 1 includes a plurality of fins aligned side by side so that respective plate-like surfaces are parallel to each other, and heat-transfer pipes passing through the respective fins in an aligning direction of the fins. Refrigerant, which circulates through a refrigerant circuit, flows in the heat-transfer pipes. In the heat exchanger 68 according to this embodiment, the heat-transfer pipes extend in an L-shape along the side surface 51*a* and the back surface 51*d* of the outdoor-unit main body 51, and as illustrated in FIG. 17, the heat-transfer pipes in a plurality of tiers are configured to pass through the fins in a zigzag manner. Further, the heat exchanger 68 is connected to the compressor 64 through a pipe 65 or the like. In addition, the heat exchanger 68 is connected to an indoor-side heat exchanger, an expansion valve, and the like (not shown) to form a refrigerant circuit of an air conditioner. Further, a board box 66 is arranged in the machine chamber 57. Devices mounted in the outdoor unit are controlled by a control board 67 provided in the board box 66.

Also in the fifth embodiment, the same advantage as that of each of the above-mentioned corresponding first to fourth embodiments can be obtained.

Note that, in the fifth embodiment, the outdoor unit of the air conditioner is exemplified as an outdoor unit including an air blower. However, the present invention is not limited thereto, but can be implemented as, for example, an outdoor unit of a hot-water supply device or the like. In addition, the present invention can be widely employed as an apparatus for blowing the air, and can be applied to an apparatus, equipment, and the like other than the outdoor unit.

Although the details of the present invention are specifically described above with reference to the preferred embodiments, it is apparent that persons skilled in the art may adopt various modifications based on the basic technical concepts and teachings of the present invention.

REFERENCE SIGNS LIST

1, 101, 201, 301 propeller fan, 3, 303 boss, 5, 105, 205 blade, 7 leading edge portion, 9 trailing edge portion, 11 outer peripheral edge, 13 inner peripheral edge, 15 leading edge protruding portion, 17, 117 trailing edge protruding portion, 51 outdoor-unit main body (casing), 61 fan motor (driving source), 68 heat exchanger, 151 trailing edge reference line, 349 cutout

The invention claimed is:

1. A propeller fan, comprising:

a rotatable boss; and a plurality of blades formed along an outer periphery of the boss, the blade having, in a shape obtained by projecting the propeller fan on a plane perpendicular to the rotation axis, a trailing edge protruding portion protruding backward in a fan rotating direction (RD) in a region between an innermost peripheral portion of a trailing edge portion and an outermost peripheral portion of the trailing edge portion, the blade having, in the shape obtained by projecting the propeller fan on the plane perpendicular to the rotation axis, a leading edge portion including a leading edge protruding portion protruding backward in the fan rotating direction, wherein an inner peripheral side of the leading edge portion with respect to an apex (P) of the leading edge protruding portion extends forward in the fan rotating direction with respect to the apex (P) of the leading edge protruding portion, wherein a radius (Rq) of an apex (Q) of the trailing edge protruding portion is larger than a radius (Rp) of the apex (P) of the leading edge protruding portion, wherein the radius (Rq) of the apex (Q) of the trailing edge protruding portion is larger than an intermediate radius (Rm) between a radius (Ro) of an outer peripheral edge and a radius (Ri) of an inner peripheral edge of the blade, and wherein the innermost peripheral portion and the apex (Q) of the trailing edge protruding portion are connected by a straight line, and a region of the trailing edge portion extending between the apex (Q) of the trailing edge portion and the innermost peripheral portion of the trailing edge portion is positioned on a forward side of the straight line in the fan rotating direction RD.

2. A propeller fan according to claim 1, wherein, a curved line which extends in the fan rotating direction from the innermost peripheral portion of the trailing edge portion toward the outermost peripheral portion of the trailing edge portion and connects the innermost peripheral portion and the outermost peripheral portion to each other is defined as a trailing edge reference line;

the trailing edge protruding portion protrudes backward in the fan rotating direction with respect to the trailing edge reference line, and an entire region of the trailing edge protruding portion is positioned on a radially outer side with respect to the radius (Rp) of the apex (P) of the leading edge protruding portion.

3. A propeller fan according to claim 1, wherein the trailing edge protruding portion comprises a region further protruding backward in the fan rotating direction (RD) with respect to a convex trailing edge line along which an entire region between the innermost peripheral portion of the trailing edge portion and the outermost peripheral portion of the trailing edge portion swells only backward in the fan rotating direction (RD).

4. A propeller fan according to claim 1, wherein the radius (Rp) of the apex (P) of the leading edge protruding portion is smaller than the intermediate radius (Rm) between the radius (Ro) of the outer peripheral edge and the radius (Ri) of the inner peripheral edge of the blade, and wherein the apex (Q) of the trailing edge protruding portion is displaced from the outermost peripheral portion of the trailing edge portion, and is separated from the outermost peripheral portion radially inward.

5. A propeller fan according to claim 1, wherein the radius of the apex (Q) of the trailing edge protruding portion is smaller than 85% of the radius (Ro) of the outer peripheral edge.

6. A propeller fan according to claim 1, wherein the boss comprises a plurality of cutouts formed therein, and wherein each of the plurality of cutouts is formed in a region between the leading edge portion of the corresponding blade and the trailing edge portion of the adjacent blade positioned on a forward side in the fan rotating direction (RD).

7. An air blower, comprising:

the propeller fan of claim 1;

a driving source for applying a driving force to the propeller fan; and a casing for housing the propeller fan and the driving source.

8. An outdoor unit, comprising:

a heat exchanger, the propeller fan of claim 1;

a driving source for applying a driving force to the propeller fan; and a casing for housing the propeller fan, the driving source, and the heat exchanger.

9. A propeller fan, comprising:

a rotatable boss; and a plurality of blades formed along an outer periphery of the boss, the blade having, in a shape obtained by projecting the propeller fan on a plane perpendicular to the rotation axis, a trailing edge protruding portion protruding backward in a fan rotating direction (RD) in a region between an innermost peripheral portion of a trailing edge portion and an outermost peripheral portion of the trailing edge portion, the blade having, in the shape obtained by projecting the propeller fan on the plane perpendicular to the rotation axis, a leading edge portion including a leading edge protruding portion protruding backward in the fan rotating direction, wherein an inner peripheral side of the leading edge portion with respect to an apex (P) of the leading edge protruding portion extends forward in the fan rotating direction with respect to the apex (P) of the leading edge protruding portion, wherein a radius (Rq) of an apex (Q) of the trailing edge protruding portion is larger than a radius (Rp) of the apex (P) of the leading edge protruding portion, wherein a curved line which extends in the fan rotating direction from the innermost peripheral portion of the trailing edge portion toward the outermost peripheral portion of the trailing edge portion and connects the innermost peripheral portion and the outermost peripheral portion to each other is defined as a trailing edge reference line; the trailing edge protruding portion protrudes backward in the fan rotating direction with respect to the trailing edge reference line, and an entire region of the trailing edge protruding portion is positioned on a radially outer side with respect to the radius (Rp) of the apex (P) of the leading edge protruding portion and wherein the innermost peripheral portion and the apex (Q) of the trailing edge protruding portion are connected by a straight line, and a region of the trailing edge portion extending between the apex (Q) of the trailing edge portion and the innermost peripheral portion of the trailing edge portion is positioned on a forward side of the straight line in the fan rotating direction RD.

10. A propeller fan according to claim 9, wherein the trailing edge protruding portion comprises a region further protruding backward in the fan rotating direction (RD) with respect to a convex trailing edge line along which an entire region between the innermost peripheral portion of the trailing edge portion and the outermost peripheral portion of the trailing edge portion swells only backward in the fan rotating direction (RD).

11. A propeller fan according to claim 9, wherein the radius (Rp) of the apex (P) of the leading edge protruding portion is smaller than the intermediate radius (Rm) between the radius (Ro) of the outer peripheral edge and the radius (Ri) of the inner peripheral edge of the blade, and wherein the apex (Q) of the trailing edge protruding portion is displaced from the outermost peripheral portion of the trailing edge portion, and is separated from the outermost peripheral portion radially inward.

12. A propeller fan according to claim 9, wherein the radius of the apex (Q) of the trailing edge protruding portion is smaller than 85% of the radius (Ro) of the outer peripheral edge.

13. A propeller fan according to claim 9, wherein the boss comprises a plurality of cutouts formed therein, and wherein each of the plurality of cutouts is formed in a region between the leading edge portion of the corresponding blade and the trailing edge portion of the adjacent blade positioned on a forward side in the fan rotating direction (RD).

14. An air blower, comprising:

the propeller fan of claim 9;

a driving source for applying a driving force to the propeller fan; and a casing for housing the propeller fan and the driving source.

15. An outdoor unit, comprising:

a heat exchanger;

the propeller fan of claim 9;

a driving source for applying a driving force to the propeller fan; and a casing for housing the propeller fan, the driving source, and the heat exchanger.

16. A propeller fan, comprising:

a rotatable boss; and a plurality of blades formed along an outer periphery of the boss, each blade having, in a shape obtained by projecting the propeller fan on a plane perpendicular to the rotation axis, a blade surface extending in a backward direction relative to a fan rotating direction (RD) from a leading edge portion to a trailing edge portion, wherein the leading edge portion of the blade surface includes a leading edge protruding portion protruding in the backward direction, the leading edge protruding portion including an apex (P) corresponding to the most backward position relative to the backward direction, the leading edge portion of the blade surface includes an inner peripheral side extending forward in the fan rotating direction (RD) with respect to the apex (P) of the leading edge protruding portion, the trailing edge portion includes an innermost peripheral portion and an outermost peripheral portion and includes a region extending between the innermost and outermost peripheral portions of the trailing edge portion while protruding in the backward direction, the trailing edge protruding portion including an apex (Q) corresponding to the most backward position relative to the backward direction, the apex (Q) has a radius (Rq) larger than a radius (Rp) of the apex (P) of the leading edge protruding portion, the radius (Rq) of the apex (Q) of the trailing edge protruding portion is larger than an intermediate radius (Rm) between a radius (Ro) of an outer peripheral edge and a radius (Ri) of an inner peripheral edge of the blade, and the innermost peripheral portion and the apex (Q) of the trailing edge protruding portion are connected by a straight line, and a region of the trailing edge portion between the apex (Q) of the trailing edge portion and the innermost peripheral portion of the trailing edge portion is positioned on a forward side of the straight line in the fan rotating direction (RD).

17. A propeller fan according to claim 16, wherein a curved line extending in the fan rotating direction from the innermost peripheral portion of the trailing edge portion toward the outermost peripheral portion and connecting the innermost peripheral portion and the outermost peripheral portion to each other is defined as a trailing edge reference line, the trailing edge protruding portion protrudes backward in the fan rotating direction with respect to the trailing edge reference line, and an entire region of the trailing edge protruding portion is positioned on a radially outer side with respect to the radius (Rp) of the apex (P) of the leading edge protruding portion.

* * * * *